US010649480B2

(12) United States Patent
Pini

(10) Patent No.: US 10,649,480 B2
(45) Date of Patent: May 12, 2020

(54) VOLTAGE REGULATOR

(71) Applicant: Nordic Semiconductor ASA, Trondheim (NO)

(72) Inventor: Francesco Pini, Trondheim (NO)

(73) Assignee: Nordic Semiconductor ASA, Trondheim (NO)

( * ) Notice: Subject to any disclaimer, the term of this patent is extended or adjusted under 35 U.S.C. 154(b) by 0 days.

(21) Appl. No.: 16/465,125

(22) PCT Filed: Nov. 30, 2017

(86) PCT No.: PCT/GB2017/053616
§ 371 (c)(1),
(2) Date: May 29, 2019

(87) PCT Pub. No.: WO2018/100382
PCT Pub. Date: Jun. 7, 2018

(65) Prior Publication Data

US 2020/0081471 A1 Mar. 12, 2020

(30) Foreign Application Priority Data

Nov. 30, 2016 (GB) ..... 1620332.5

(51) Int. Cl.
*G05F 1/618* (2006.01)
*G05F 1/575* (2006.01)
*G05F 1/563* (2006.01)

(52) U.S. Cl.
CPC ..... *G05F 1/618* (2013.01); *G05F 1/575* (2013.01); *G05F 1/563* (2013.01)

(58) Field of Classification Search
CPC ..... G05F 1/563; G05F 1/575; G05F 1/618
See application file for complete search history.

(56) References Cited

U.S. PATENT DOCUMENTS 5,966,004 A * 10/1999 Kadanka ..... G05F 1/618 323/224
6,333,623 B1 12/2001 Heisley et al.
(Continued)

FOREIGN PATENT DOCUMENTS

CN 102707757 A 10/2012

OTHER PUBLICATIONS

International Search Report and Written Opinion for PCT/GB2017/053616, dated Feb. 19, 2018, 14 pages.
(Continued)

*Primary Examiner* — Fred E Finch, III
(74) *Attorney, Agent, or Firm* — Klarquist Sparkman, LLP

(57) ABSTRACT

A voltage regulator is arranged to receive an input voltage ($V_{in}$) and produce a regulated output voltage ($V_{out}$) and comprises: a current source transistor ($M_{source}$) and a current sink transistor ($M_{sink}$) arranged to provide the output voltage at a node therebetween; a first error amplifier; and a second error amplifier. The first error amplifier is arranged to apply a first control voltage to the gate terminal of the current source transistor, wherein the first control voltage is dependent on the difference between the feedback voltage ($V_{fb}$) and the reference voltage ($V_{ref}$). The second error amplifier arranged in parallel to the first error amplifier, the second error amplifier being arranged to apply a second control voltage to the gate terminal of the current sink transistor, wherein the second control voltage is dependent on the difference between the feedback voltage and the reference voltage. The feedback voltage is derived from the output voltage.

16 Claims, 3 Drawing Sheets

(56) References Cited

U.S. PATENT DOCUMENTS

| | | | | |
|---|---|---|---|---|
| 10,503,187 | B1 * | 12/2019 | Hodge, Jr. | H02M 3/07 |
| 2008/0116862 | A1 | 5/2008 | Yang et al. | |
| 2010/0045249 | A1 | 2/2010 | Park et al. | |
| 2013/0113446 | A1 | 5/2013 | De Haas | |
| 2015/0115918 | A1 * | 4/2015 | Oikarinen | G05F 1/575 323/280 |
| 2015/0207406 | A1 * | 7/2015 | Potanin | G05F 1/575 323/282 |
| 2015/0220094 | A1 * | 8/2015 | Ho | G05F 1/575 323/280 |
| 2018/0136681 | A1 * | 5/2018 | Chang | G05F 1/618 |
| 2018/0181152 | A1 * | 6/2018 | Lu | G05F 1/618 |
| 2018/0224875 | A1 * | 8/2018 | Ham | G05F 1/59 |

OTHER PUBLICATIONS

Search Report under Section 17(5) for GB1620332.5, dated Jul. 18, 2017, 3 pages.

* cited by examiner

VOLTAGE REGULATOR

CROSS REFERENCE TO RELATED APPLICATIONS

This is the U.S. National Stage of International Application No. PCT/GB2017/053616, filed Nov. 30, 2017, which was published in English under PCT Article 21(2), which in turn claims the benefit of Great Britain Application No. 1620332.5, filed Nov. 30, 2016.

The present invention relates to voltage regulators, particularly low-dropout voltage regulators.

Low-dropout (or LDO) voltage regulators are linear DC voltage regulators that are capable of operating with very low input-output differential voltages. Such regulators are usually chosen because they have a low minimum operating voltage, relatively high power efficiency compared to some other linear regulators, and low heat dissipation. These properties together with their linear behaviour and low voltage dropout make typical LDO voltage regulators a popular choice for supplying or "sourcing" current to on-chip loads.

An LDO voltage regulator is typically constructed from an error amplifier (an operational transconductance amplifier or "OTA"), a pass field-effect-transistor (FET) or "pass-FET", and a feedback network. The load current is sourced to the load through the pass-FET and the output voltage is regulated through the feedback network, assuming that the loop including the error amplifier, the pass-FET, and the feedback network provides sufficient loop gain. The output voltage is equal to the reference voltage multiplied by the reciprocal of the attenuation of the feedback network if the loop gain is sufficiently high.

Conventional LDO voltage regulators may also be able to absorb or "sink" a small amount of current from the output node. The feedback network typically provides a path from the regulated output node to ground. However, the Applicant has appreciated that this typically works only if the current to be sinked is orders of magnitude smaller than the quiescent current of the feedback network.

According to a first aspect, the present invention provides a voltage regulator arranged to receive an input voltage and produce a regulated output voltage, the voltage regulator comprising:

- a current source transistor and a current sink transistor arranged to provide the output voltage at a node therebetween;
- a first error amplifier arranged to compare a feedback voltage to a reference voltage and apply a first control voltage to a gate terminal of the current source transistor, wherein said first control voltage is dependent on a difference between the feedback voltage and the reference voltage;
- a second error amplifier arranged in parallel to the first error amplifier, said second error amplifier being arranged to compare the feedback voltage to the reference voltage and apply a second control voltage to a gate terminal of the current sink transistor, wherein said second control voltage is dependent on a difference between the feedback voltage and the reference voltage;
- wherein said feedback voltage is derived from the output voltage.

Thus it will be appreciated by those skilled in the art that in accordance with the present invention an LDO voltage regulator may have two separate error amplifiers in parallel and two separate pass-FETs. These two pass-FETs may be arranged such that the current source transistor is able to source current to the output when made to conduct by the first error amplifier, while the current sink transistor is able to sink current from the output when made to conduct by the second error amplifier. Embodiments of the present invention are advantageously capable of sinking currents from the output that are orders of magnitude greater than the quiescent current of the feedback path while maintaining the desired value of the regulated output voltage. Embodiments of the present invention are also advantageously able to allow voltage regulating with a very low bias current during normal operation—i.e. during current sourcing as opposed to current sinking.

The present invention may be particularly advantageous, by way of non-limiting example only, in circuits provided with multiple voltage regulators which are used under different operating conditions. For example an LDO voltage regulator in accordance with embodiments of the present invention may be provided alongside a further voltage regulator (e.g. a high power LDO voltage regulator) and a DC-DC buck converter. This further voltage regulator and buck converter may leak current (e.g. up to 10 μA) when powered down, typically due to leakage current associated with a pass-FET within the further regulator or power switches within the buck converter. This leakage current is then seen as a constant DC current sinked into the output of the LDO voltage regulator.

In some embodiments, the voltage regulator comprises a feedback network arranged to provide the feedback voltage which depends on the output voltage. While the feedback network or networks may be constructed using passive components such as resistors, inductors and capacitors or using a digital controller, in at least some embodiments, the feedback network(s) comprise(s) a ladder of diode-connected metal-oxide-semiconductor field-effect-transistors.

It should be appreciated that the reference voltages used by the first and second error amplifiers should be the same or at least substantially the same. Similarly, the feedback voltages used by the first and second error amplifiers should also be the same or at least substantially the same. The term "substantially the same" as used herein with respect to the reference and feedback voltages means that they are the same for each error amplifier, except for process variations. The reference voltage and/or feedback voltage could theoretically be changed in value (e.g. using a potential divider) before being used by one of the error amplifiers which would make the local value entering the two error amplifiers different despite being derived from the same voltage originally, but this is not preferred as it would require corresponding changes within the affected error amplifier to accommodate this and may lead to unnecessary sources of error and undesirable increases in chip area and power consumption.

In some embodiments, the current source transistor comprises a p-channel metal-oxide-semiconductor field-effect-transistor (pMOSFET). In some potentially overlapping embodiments, the current sink transistor comprises an n-channel metal-oxide-semiconductor field-effect-transistor (nMOSFET).

In some embodiments, the source terminal of the current source transistor is connected to the input voltage. In some potentially overlapping embodiments, the source terminal of the current sink transistor is connected to ground.

In some embodiments, the respective drain terminals of the current source transistor and the current sink transistor are connected together at the node arranged to provide the output voltage. It will be appreciated by those skilled in the art that in accordance with such embodiments, the current source and sink transistors may form a "push-pull" pair.

While it will be appreciated that there are a number of error amplifier topologies known in the art per se, in some embodiments the first error amplifier comprises first and second differential nMOSFETs, wherein the gate terminal of the first differential nMOSFET is connected to the feedback voltage, the gate terminal of the second differential nMOSFET is connected to the reference voltage.

In some potentially overlapping embodiments, the first error amplifier further comprises a constant current source. In the set of embodiments wherein the first error amplifier comprises first and second differential nMOSFETs, the constant current source may be connected to the source terminals of said first and second differential nMOSFETs. This constant current source provides a constant bias current to the first error amplifier such that it can vary the conductivity of the current source transistor during normal operation.

In a set of potentially overlapping embodiments, the first error amplifier further comprises a first current mirror comprising first and second mirror pMOSFETs arranged such that:

the gate and drain terminals of the first mirror pMOSFET are connected to the gate terminal of the second mirror pMOSFET and the drain terminal of the first differential nMOSFET;

the drain terminal of the second mirror pMOSFET is connected to the drain terminal of the second differential nMOSFET; and the source terminals of the first and second mirror pMOSFETs are connected to the input voltage. Those skilled in the art will appreciate that this provides a current mirror load to the first error amplifier.

In some such embodiments, the second error amplifier further comprises a tail transistor arranged such that its drain terminal is connected to the respective source terminals of the first and second differential pMOSFETs and its gate terminal is connected to the gate and drain terminals of the first mirror pMOSFET. In a set of embodiments, the tail transistor is a pMOSFET.

In a potentially overlapping set of embodiments, the second error amplifier comprises first and second differential pMOSFETs, wherein the gate terminal of the first differential pMOSFET is connected to the feedback voltage, and the gate terminal of the second differential pMOSFET is connected to the reference voltage. In some embodiments described above, the bias current of the second error amplifier can be controlled by the first error amplifier, reducing the overall current consumption of the LDO voltage regulator when the current sinking feature is not required. More generally, in a set of embodiments, the first error amplifier is arranged to vary a bias current provided to the second error amplifier.

In a set of potentially overlapping embodiments, the second error amplifier further comprises a second current mirror comprising first and second mirror nMOSFETs arranged such that:

the gate and drain terminals of the first mirror nMOSFET are connected to the gate terminal of the second mirror nMOSFET and the drain terminal of the first differential pMOSFET;

the drain terminal of the second mirror nMOSFET is connected to the drain terminal of the second differential pMOSFET; and the source terminals of the first and second mirror nMOSFETs are connected to ground.

Certain embodiments of the invention will now be described, by way of example only, with reference to the accompanying drawings in which.

Figure 1:
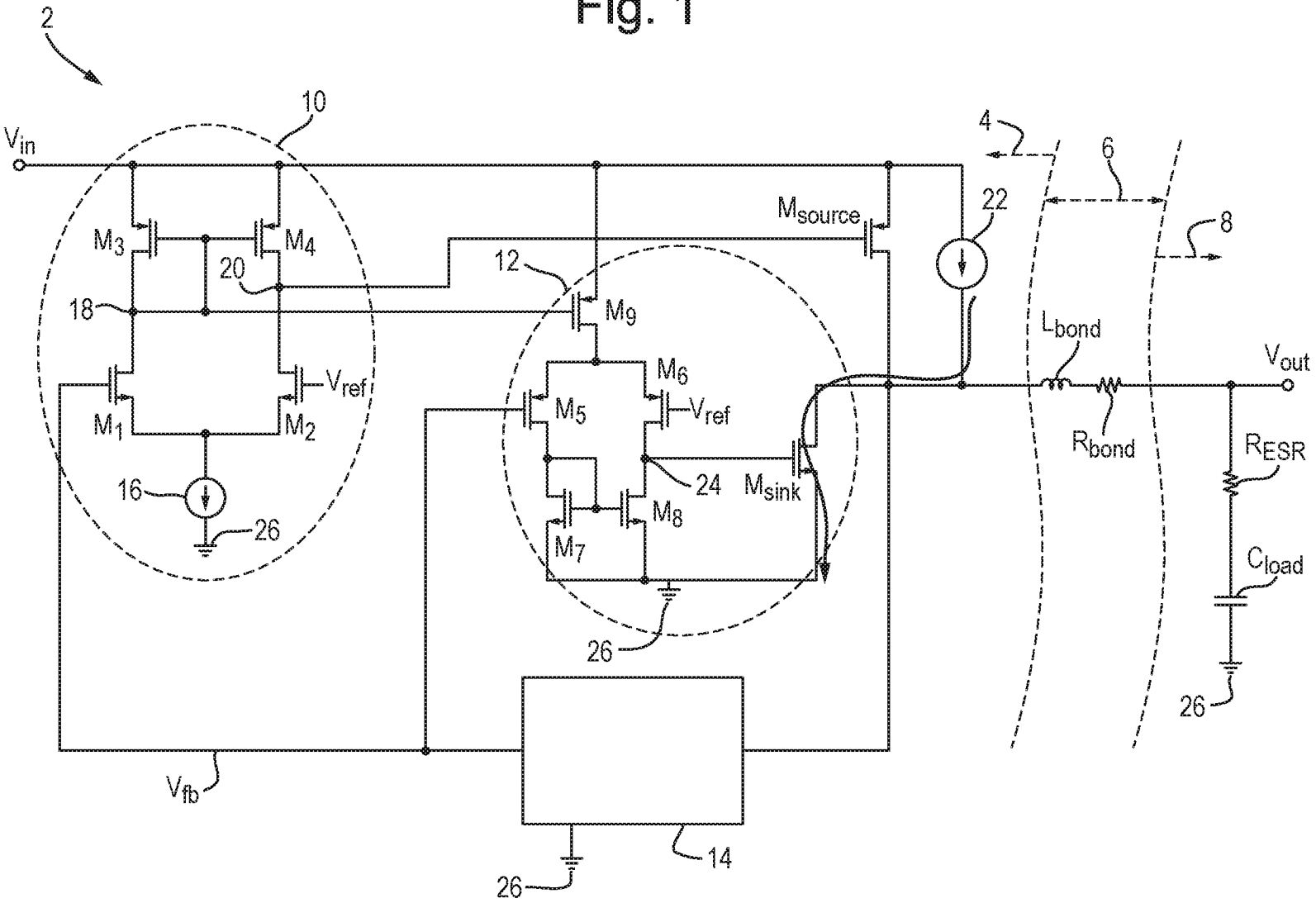
FIG. 1 is a circuit diagram of a low-dropout voltage regulator in accordance with an embodiment of the present invention.

FIG. 1 shows a low-dropout (LDO) voltage regulator 2 in accordance with an embodiment of the present invention. While it will be appreciated that the LDO voltage regulator 2 itself comprises the components in the "on-chip" domain 4, FIG. 1 also shows the bond wire domain 6 and the off-chip domain 8. The LDO voltage regulator 2 comprises: a first error amplifier 10; a second error amplifier 12; a feedback network 14; a current source transistor $M_{source}$; and a current sink transistor $M_{sink}$. The LDO voltage regulator 2 is arranged to receive an input voltage $V_{in}$ and generate a regulated output voltage $V_{out}$.

The feedback network 14 may comprise a ladder of diode-connected pMOS transistors arranged to generate a feedback voltage $V_{fb}$ which is input to the first and second error amplifiers 10, 12. This feedback voltage $V_{fb}$ is derived from the output voltage $V_{out}$ and is compared to a reference voltage $V_{ref}$ via each of the error amplifiers 10, 12. It will be appreciated that while the two error amplifiers 10, 12 could utilise different local feedback voltages each derived from the output voltage $V_{out}$, this may lead to undesirable "mismatch" errors together with an increase in circuit area and power consumption and so it is preferred that each error amplifier 10, 12 receives the same feedback voltage $V_{fb}$. It is also preferred that the reference voltage used by each error amplifier 10, 12 is the same for analogous reasons.

The first error amplifier 10 comprises a differential pair of nMOS transistors $M_1$, $M_2$ and a current mirror load constructed from two pMOS transistors $M_3$, $M_4$. The differential pair transistors $M_1$, $M_2$ are arranged such that their respective source terminals are connected to ground 26 via a current source 16 which provides the differential pair with a constant bias current. The gate terminal of the first nMOS differential pair transistor $M_1$ is connected to the output of the feedback network 14 such that the feedback voltage $V_{fb}$ is applied to the gate terminal of $M_1$. The gate terminal of the second nMOS differential pair transistor $M_2$ is connected to the reference voltage $V_{ref}$. The drain terminal of $M_1$ is connected at a node 18 to the drain terminal of $M_3$ and the gate terminals of both $M_3$ and $M_4$. The drain terminal of $M_2$ is connected at a node 20 to the drain terminal of $M_4$ and to the gate terminal of the current source transistor $M_{source}$. The respective source terminals of the pMOS mirror transistors $M_3$, $M_4$ are connected to the input voltage $V_{in}$.

The second error amplifier 12 comprises a differential pair of pMOS transistors $M_5$, $M_6$ and a current mirror load comprising a pair of nMOS mirror transistors $M_7$, $M_8$. The gate terminal of the first pMOS differential transistor $M_5$ is connected to the output of the feedback network 14 such that the feedback voltage $V_{fb}$ is applied to the gate terminal of $M_5$ while the gate terminal of $M_6$ is connected to the reference voltage $V_{ref}$. The drain terminal of $M_5$ is connected to the drain terminal of $M_7$ and the respective gate terminals of $M_7$ and $M_8$. The drain terminal of $M_6$ is connected to the drain terminal of $M_8$ and to the gate terminal of the current sink transistor $M_{sink}$. The respective source terminals of $M_7$, $M_8$, $M_{sink}$ are connected to ground 26.

The respective source terminals of the pMOS differential pair transistors $M_5$, $M_6$ are connected to the drain terminal of a pMOS tail transistor $M_9$, which has its respective source terminal connected to the input voltage $V_{in}$ and its gate terminal connected to the node 18 and thus the respective drain terminals of $M_1$ and $M_3$ within the first error amplifier 10.

While not a part of the voltage regulator 2, the inductance and resistance of the bond wire 6 are depicted in FIG. 1 as $L_{bond}$ and $R_{bond}$ respectively. A load capacitance $C_{load}$ and equivalent series resistance $R_{ESR}$ are shown connected to the output of the voltage regulator 2, i.e. the output voltage $V_{out}$ is applied across these in the off-chip domain 8.

The technical operation of the LDO voltage regulator 2 shown in FIG. 1 will now be described. When sourcing load current in normal use, the conductance of the source transistor $M_{source}$ is high enough that current flows from the input voltage $V_{in}$ to the output of the LDO voltage regulator 2. The feedback network 14 varies the feedback voltage $V_{fb}$ in order to regulate the output voltage $V_{out}$, assuming that each loop including the error amplifier 10, 12, the corresponding pass-FET $M_{source}$, $M_{sink}$, and the feedback network 14 provides sufficient gain, in a manner known per se.

Figure 2:
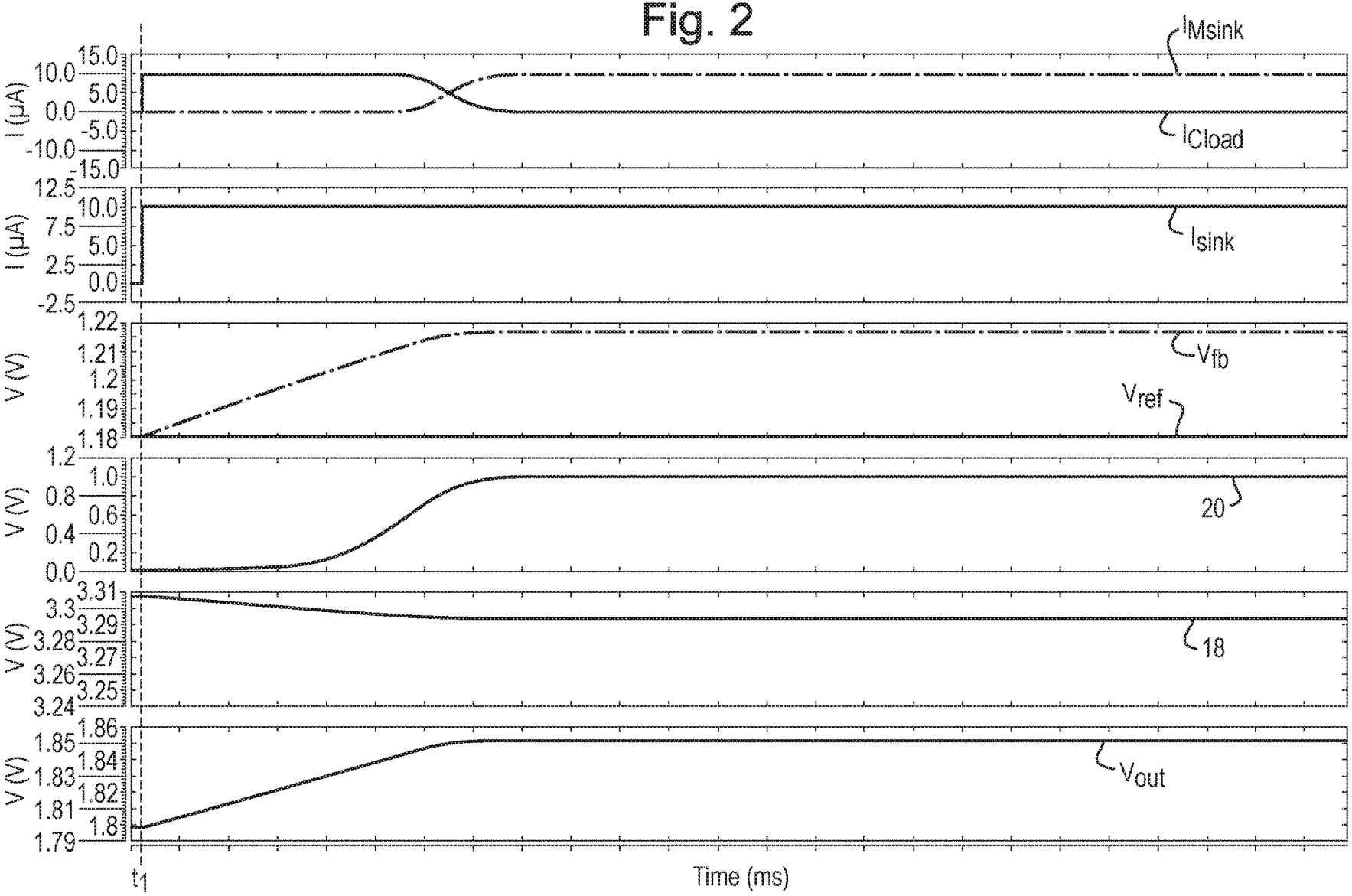
FIG. 2 is a simulated graph illustrating the behaviour of the circuit shown in FIG. 1 when sinking current.

FIG. 2 illustrates the behaviour of a number of voltages and currents in the LDO voltage regulator 2 in response to a load current $I_{sink}$ (shown in FIG. 1 as a current source 22) being abruptly sunk into the output of the LDO voltage regulator 2. Assuming that the abrupt sinking occurs a time $t_1$, the output voltage $V_{out}$ is seen thereafter to increase linearly due to the charging of the load capacitance (i.e.)

$$\left(i.e.\ \frac{\delta Vout}{\delta T} = \frac{Isink}{Cload}\right).$$

At the time of the abrupt change in current, the capacitor is the lowest impedance path and thus the path along which the current is sinked. This results in an increase of the feedback voltage $V_{fb}$ which subsequently deviates from the reference voltage $V_{ref}$ which, due to the behaviour of the differential pair comprising $M_1$ and $M_2$, decreases the voltage at the node 18 between the respective drain terminals of $M_1$ and $M_3$. The decreased voltage at this node 18 increases the bias current provided to the second error amplifier 12 due to the increased conductance of the pMOS tail transistor $M_9$. The current $I_{cload}$ through the load capacitance $C_{load}$ undergoes a sharp increase in response to the increased current $I_{sink}$ sunk into the output, but eventually reduces to zero when the feedback voltage $V_{fb}$ reaches its final value.

This deviation of the feedback voltage $V_{fb}$ from the reference voltage $V_{ref}$ also causes the voltage at the node 24 between the respective drain terminals of $M_6$ and $M_8$ to increase which, due to its connection to the gate terminal of the current sinking transistor $M_{sink}$, increases the conductivity of the sinking transistor $M_{sink}$ thus providing a direct path to ground 26 from the current source 22, i.e. the current $I_{Msink}$ through the sinking transistor $M_{sink}$ increases. This prevents the charging of the load capacitance $C_{load}$ and as a result limits the increase in the output voltage $V_{out}$ due to the current being sunk into the output of the LDO voltage regulator 2.

It will be appreciated that the second error amplifier 12 provides a parallel feedback loop that only operates when a current is sunk into the output of the LDO voltage regulator 2, allowing the LDO voltage regulator 2 to continue regulating the output voltage $V_{out}$ even under such circumstances while requiring very low bias current during normal operation (i.e. current sourcing operation) due to the connection between the pMOS tail transistor $M_9$ and the node 18 in the first error amplifier 10.

Figure 3:
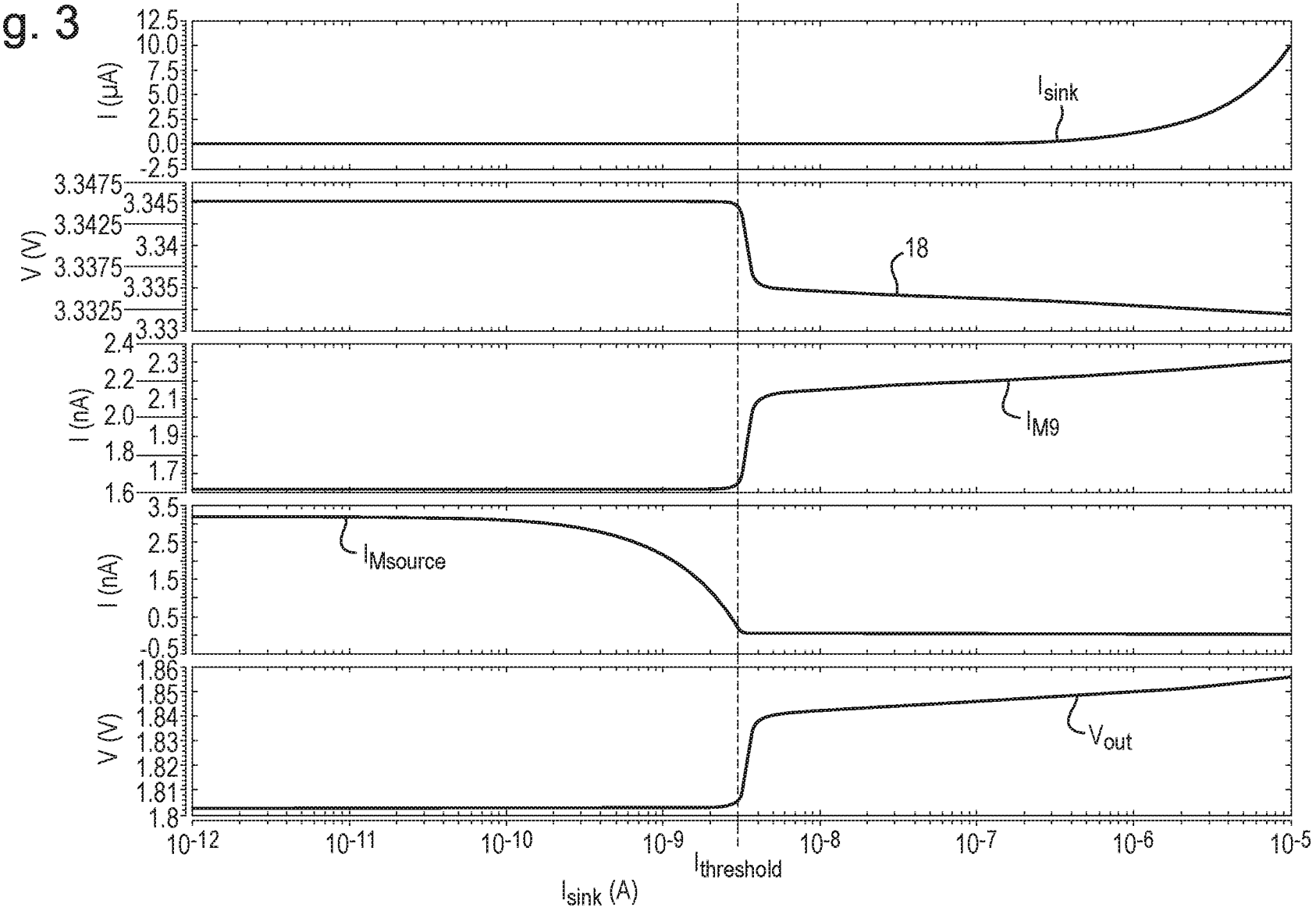
FIG. 3 is a simulated graph further illustrating the behaviour across a range of values of a current being sinked into the circuit shown in FIG. 1.

FIG. 3 illustrates the behaviour of a number of voltages and currents in the LDO voltage regulator 2 in response to different values of load current $I_{sink}$ (shown in FIG. 1 as a current source 22) being sunk into the output of the LDO voltage regulator 2. The various plots shown in FIG. 3 are a function of the current $I_{sink}$ on a logarithmic scale. The uppermost plot simply shows a plot of the load current $I_{sink}$ on a linear scale (in microamps).

The second plot shows the voltage at the node 18, the third plot shows the current $I_{M9}$ through the pMOS tail transistor $M_9$, the fourth plot shows the current $I_{Msource}$ through $M_{source}$, and the fifth plot shows the output voltage Vout, and all four plots are shown as a function of the current $I_{sink}$. As the sinking current $I_{sink}$ increases, the current $I_{Msource}$ through $M_{source}$ decreases non-linearly until a particular threshold current $I_{threshold}$, after which $M_{source}$ is fully disabled and the current $I_{Msource}$ falls to 0 A. When the current $I_{sink}$ sinked into the output of the LDO voltage regulator 2 exceeds this value (i.e. $I_{sink}$ is larger than the threshold current $I_{threshold}$), the feedback voltage $V_{fb}$ increases due to the capacitor $C_{load}$ and thus deviates from the reference voltage $V_{ref}$ as described previously. This decreases the voltage at the node 18 between the respective drain terminals of $M_1$ and $M_3$ which increases the current $I_{M9}$ through the pMOS tail transistor $M_9$. This increase in the current $I_{M9}$ biases the second differential amplifier 12 which, due to the difference between the voltages $V_{fb}$ and $V_{ref}$ applied to the respective gate terminals of $M_5$ and $M_6$, causes $M_{sink}$ to conduct and sink the current $I_{sink}$ as described previously. The increase in the conductivity of the sinking transistor $M_{sink}$ provides a direct path to ground 26 from the current source 22, which prevents the charging of the load capacitance $C_{load}$ and limits the increase in the output voltage $V_{out}$ due to the current being sunk into the output of the LDO voltage regulator 2.

Thus it will be seen that embodiments of the present invention provide an improved low-dropout voltage regulator that is arranged such that a current can be sunk from the output, for example when the regulator receives leakage current from another regulator. The current that can be sunk may be orders of magnitude greater than the quiescent current of the feedback path while maintaining the desired value of the regulated output voltage. It will be appreciated by those skilled in the art that the embodiments described above are merely exemplary and are not limiting on the scope of the invention.

The invention claimed is:

1. A voltage regulator arranged to receive an input voltage and produce a regulated output voltage, the voltage regulator comprising:

a current source transistor and a current sink transistor arranged to provide the output voltage at a node therebetween;

a first error amplifier arranged to compare a feedback voltage to a reference voltage and apply a first control voltage to a gate terminal of the current source transistor, wherein said first control voltage is dependent on a difference between the feedback voltage and the reference voltage;

a second error amplifier arranged in parallel to the first error amplifier, said second error amplifier being arranged to compare the feedback voltage to the reference voltage and apply a second control voltage to a gate terminal of the current sink transistor, wherein said second control voltage is dependent on a difference between the feedback voltage and the reference voltage;

wherein said feedback voltage is derived from the output voltage and wherein the first error amplifier is arranged to vary a bias current provided to the second error amplifier.

2. The voltage regulator as claimed in claim 1, comprising a feedback network arranged to provide the feedback voltage which depends on the output voltage.

3. The voltage regulator as claimed in claim 2, wherein the feedback network comprises a ladder of diode-connected metal-oxide-semiconductor field-effect-transistors.

4. The voltage regulator as claimed in claim 1, wherein the current source transistor comprises a p-channel metal-oxide-semiconductor field-effect-transistor.

5. The voltage regulator as claimed in claim 1, wherein the current sink transistor comprises an n-channel metal-oxide-semiconductor field-effect-transistor.

6. The voltage regulator as claimed in claim 1, wherein the source terminal of the current source transistor is connected to the input voltage.

7. The voltage regulator as claimed in claim 1, wherein the source terminal of the current sink transistor is connected to ground.

8. The voltage regulator as claimed in claim 1, wherein the respective drain terminals of the current source transistor and the current sink transistor are connected together at the node arranged to provide the output voltage.

9. The voltage regulator as claimed in claim 1, wherein the first error amplifier comprises first and second differential n-channel metal-oxide-semiconductor field-effect-transistors, arranged such that the gate terminal of the first differential n-channel metal-oxide-semiconductor field-effect-transistor is connected to the feedback voltage, and the gate terminal of the second differential n-channel metal-oxide-semiconductor field-effect-transistor is connected to the reference voltage.

10. The voltage regulator as claimed in claim 1, wherein the first error amplifier comprises a constant current source.

11. The voltage regulator as claimed in claim 9, wherein the first error amplifier comprises a constant current source connected to the source terminals of said first and second differential n-channel metal-oxide-semiconductor field-effect-transistors.

12. The voltage regulator as claimed in claim 9, wherein the first error amplifier comprises a first current mirror comprising first and second mirror p-channel metal-oxide-semiconductor field-effect-transistors arranged such that:

the gate and drain terminals of the first mirror p-channel metal-oxide-semiconductor field-effect-transistor are connected to the gate terminal of the second mirror p-channel metal-oxide-semiconductor field-effect-transistor and the drain terminal of the first differential n-channel metal-oxide-semiconductor field-effect-transistor;

the drain terminal of the second mirror p-channel metal-oxide-semiconductor field-effect-transistor is connected to the drain terminal of the second differential n-channel metal-oxide-semiconductor field-effect-transistor; and the source terminals of the first and second mirror p-channel metal-oxide-semiconductor field-effect-transistors are connected to the input voltage.

13. The voltage regulator as claimed in claim 12, wherein the second error amplifier comprises a tail transistor arranged such that its drain terminal is connected to the respective source terminals of the first and second differential p-channel metal-oxide-semiconductor field-effect-transistors and its gate terminal is connected to the gate and drain terminals of the first mirror p-channel metal-oxide-semiconductor field-effect-transistor.

14. The voltage regulator as claimed in claim 13, wherein the tail transistor is a p-channel metal-oxide-semiconductor field-effect-transistor.

15. The voltage regulator as claimed in claim 1, wherein the second error amplifier comprises first and second differential p-channel metal-oxide-semiconductor field-effect-transistors, arranged such that the gate terminal of the first differential p-channel metal-oxide-semiconductor field-effect-transistor is connected to the feedback voltage, and the gate terminal of the second differential p-channel metal-oxide-semiconductor field-effect-transistor is connected to the reference voltage.

16. The voltage regulator as claimed in claim 15, wherein the second error amplifier further comprises a second current mirror comprising first and second mirror n-channel metal-oxide-semiconductor field-effect-transistors arranged such that:

the gate and drain terminals of the first mirror n-channel metal-oxide-semiconductor field-effect-transistor are connected to the gate terminal of the second mirror n-channel metal-oxide-semiconductor field-effect-transistor and the drain terminal of the first differential p-channel metal-oxide-semiconductor field-effect-transistor;

the drain terminal of the second mirror n-channel metal-oxide-semiconductor field-effect-transistor is connected to the drain terminal of the second differential p-channel metal-oxide-semiconductor field-effect-transistor; and the source terminals of the first and second mirror n-channel metal-oxide-semiconductor field-effect-transistors are connected to ground.

* * * * *